US008356449B2

(12) United States Patent
Lin

(10) Patent No.: US 8,356,449 B2
(45) Date of Patent: Jan. 22, 2013

(54) FLOOR SPAN CONNECTOR

(76) Inventor: Jin-Jie Lin, Livermore, CA (US)

( * ) Notice: Subject to any disclaimer, the term of this patent is extended or adjusted under 35 U.S.C. 154(b) by 579 days.

(21) Appl. No.: 12/311,923

(22) PCT Filed: Oct. 18, 2006

(86) PCT No.: PCT/US2006/040376

§ 371 (c)(1),
(2), (4) Date: Apr. 16, 2009

(87) PCT Pub. No.: WO2008/048253

PCT Pub. Date: Apr. 24, 2008

(65) Prior Publication Data

US 2010/0088997 A1 Apr. 15, 2010

(51) Int. Cl.
*E02D 5/74* (2006.01)
*E02D 5/70* (2006.01)

(52) U.S. Cl. ..... 52/293.3; 52/295; 52/293.1; 52/698; 52/701; 52/703; 52/745.21

(58) Field of Classification Search ..... 52/703, 52/701, 698, 714, 712, 295, 223.13, 236.7, 52/236.9, 236.6, 650.2, 696, 293.3, 293.1, 52/745.12, 745.21
See application file for complete search history.

(56) References Cited

U.S. PATENT DOCUMENTS

| | | | | | |
|---|---|---|---|---|---|
| 573,452 | A | | 12/1896 | Delahunt | |
| 874,514 | A | | 12/1907 | Lindow | |
| 1,459,918 | A | | 6/1923 | McGaw | |
| 1,575,689 | A | | 3/1926 | Kalgren | |
| 1,767,575 | A | | 6/1930 | Bujack | |
| 1,775,780 | A | * | 9/1930 | Papalas | 52/714 |
| 2,178,782 | A | * | 11/1939 | Dunlap | 52/565 |
| 2,181,698 | A | * | 11/1939 | Langenberg | 52/258 |
| 2,192,521 | A | | 9/1940 | McGaw | |
| 2,348,314 | A | * | 5/1944 | Spalding | 52/778 |
| 2,649,625 | A | * | 8/1953 | Johnson | 52/246 |
| 2,710,159 | A | | 6/1955 | Gordon | |
| 3,535,846 | A | * | 10/1970 | Storch | 52/698 |
| 3,750,360 | A | | 8/1973 | Kingston | |
| 3,782,058 | A | | 1/1974 | Allen | |
| 3,998,026 | A | | 12/1976 | Allen | |
| 4,040,589 | A | | 8/1977 | McLay | |
| 4,321,776 | A | | 3/1982 | Delight | |
| 4,404,781 | A | | 9/1983 | Gilb | |
| 4,413,456 | A | | 11/1983 | Gilb | |

(Continued)

FOREIGN PATENT DOCUMENTS

SU 767330 10/1980

OTHER PUBLICATIONS

Simpson Strong-Tie Company, Inc., LGT2/MGT/HGT Heavy Girder Tiedowns, Simpson Strong-Tie Catalog, 2000, p. 109, Simpson Strong-Tie Company, Inc., USA.

(Continued)

*Primary Examiner* — Phi D. A
(74) *Attorney, Agent, or Firm* — James R. Cypher; Charles R. Cypher

(57) ABSTRACT

A connector for connecting wall studs of two adjacent floors in a light frame building structure, the connector having a first attachment tab, a seat member, a diagonally slanted support leg, and a second attachment tab, all substantially planar. The connector is intended to be paired and the paired connectors joined by an elongated tie member that pierces the sill plates of the intervening floor structure.

32 Claims, 5 Drawing Sheets

U.S. PATENT DOCUMENTS

| | | | | | |
|---|---|---|---|---|---|
| 4,441,286 | A | | 4/1984 | Skvaril | |
| 4,483,119 | A | | 11/1984 | Hernandez | |
| 4,498,816 | A | | 2/1985 | Korpela et al. | |
| 4,531,335 | A | * | 7/1985 | Mangan | 52/208 |
| 4,649,689 | A | * | 3/1987 | Everman et al. | 52/701 |
| 4,666,344 | A | | 5/1987 | Seegmiller | |
| 4,699,547 | A | | 10/1987 | Seegmiller | |
| 4,707,955 | A | | 11/1987 | Clapson | |
| 4,730,701 | A | | 3/1988 | Miller, Jr. et al. | |
| 4,811,542 | A | | 3/1989 | Jewell | |
| 4,875,314 | A | | 10/1989 | Boilen | |
| 4,910,934 | A | | 3/1990 | Hennings | |
| 4,922,679 | A | * | 5/1990 | Fricker | 52/698 |
| 4,924,648 | A | * | 5/1990 | Gilb et al. | 52/295 |
| 4,953,339 | A | | 9/1990 | Jewell | |
| 4,965,980 | A | | 10/1990 | Leavens | |
| 5,150,553 | A | * | 9/1992 | Commins et al. | 52/264 |
| 5,174,539 | A | | 12/1992 | Leonard | |
| 5,212,919 | A | | 5/1993 | Shaw et al. | |
| 5,240,217 | A | | 8/1993 | Lizakowski | |
| 5,301,485 | A | | 4/1994 | Shaw et al. | |
| 5,303,520 | A | | 4/1994 | Gozdziak | |
| 5,364,214 | A | * | 11/1994 | Fazekas | 411/536 |
| 5,398,476 | A | * | 3/1995 | Knight | 52/698 |
| 5,595,031 | A | * | 1/1997 | Commins | 52/264 |
| 5,667,181 | A | * | 9/1997 | van Leeuwen et al. | 248/343 |
| 5,670,076 | A | * | 9/1997 | Leek | 249/53 M |
| 5,732,519 | A | * | 3/1998 | Leek | 52/293.3 |
| 5,761,863 | A | | 6/1998 | Sutt, Jr. et al. | |
| 5,813,181 | A | | 9/1998 | Ashton et al. | |
| 5,813,182 | A | * | 9/1998 | Commins | 52/295 |
| 5,832,679 | A | | 11/1998 | Roth | |
| 5,921,042 | A | | 7/1999 | Ashton et al. | |
| 6,014,843 | A | | 1/2000 | Crumley et al. | |
| 6,112,486 | A | | 9/2000 | Ashton et al. | |
| 6,389,767 | B1 | | 5/2002 | Lucey et al. | |
| 6,425,220 | B1 | | 7/2002 | Ashton et al. | |
| 6,550,200 | B1 | | 4/2003 | Mueller | |
| 6,560,940 | B2 | | 5/2003 | Mueller | |
| 6,840,021 | B1 | | 1/2005 | Ashmore et al. | |
| 6,877,291 | B2 | | 4/2005 | Shamroukh et al. | |
| 7,017,312 | B1 | | 3/2006 | Mueller | |
| 7,334,372 | B2 | * | 2/2008 | Evans et al. | 52/289 |
| 2003/0213194 | A1 | * | 11/2003 | Kawai et al. | 52/272 |
| 2009/0165409 | A1 | * | 7/2009 | McClain et al. | 52/293.3 |

OTHER PUBLICATIONS

USP Structural Connectors Full Line Catalog, 2004, p. 54, 59, 61, USP Structural Connectors, USA.

KC Metals Superspeed Connectors Full Line Catalog, 1992, pp. 48-51, KC Metal Products, Inc., USA.

USP Lumber Connectors Full Line Catalog, 2000, pp. 10-11, pp. 86-89, USP Connectors, USA.

Tanaka Steel, Tanaka Steel Catalog, 2001, 3 pages, Tanaka Steel Company, Japan.

Simpson Strong-Tie Company, Inc., Full Line Catalog, 1987, p. 5, Simpson Strong-Tie Company, Inc., USA.

Commins, Alfred D. and Gregg, Robert C., Cyclic Performance of Tall-Narrow Shearwall Assemblies, Apr. 5, 1994, Simpson Strong-Tie Company, Inc., USA.

* cited by examiner

FLOOR SPAN CONNECTOR

BACKGROUND OF THE INVENTION

1. Field of the Invention

The present invention relates to the construction industry and, in particular, concerns a method of interconnecting building members with paired connectors and tie rods.

2. Description of the Related Art

In typical residential and light industrial and commercial building frame wall construction, load bearing frame walls comprise a series of studs and posts that are anchored to the foundation and covered with sheathing material installed over both sides of the frame. Typically, the frame is constructed from a number of vertically extending studs that are positioned between and connected to horizontally extending top and bottom plates. The bottom plate and the vertical studs are typically anchored to the foundation by some means. The sheathing material, which can be plywood, gypsum wallboard, siding, plaster, or the like, is then attached over the studs.

Natural forces commonly impose vertical and horizontal forces on the structural elements of the buildings. These forces can be the result of earth movements in an earthquake and from high-velocity winds, as in a hurricane or tornado. If these forces exceed the structural capacity of the building, they can cause structural failures leading to anything from minor damage to catastrophic destruction of the building, attendant economic loss, and injuries or fatalities.

The typical method of interconnecting the stories of a building is to use lengths of coil strap to tie the studs of an upper to story to the studs of the story below. The disadvantages of coil strap are manifold. Coil strap cannot be installed within a wall because of the intervening sill plates. Coil strap cannot accommodate any offset in the upper and lower studs. Wood shrinkage after strap installation across horizontal wood members can cause the strap to buckle outward. Coil strap is a general-purpose utility strap that is not tailored to the specific connection. Vertically-paired holdowns can eliminate some of the disadvantages of the coil strap, but holdowns are typically engineered for higher load values that are necessary in a floor-to-floor connection and therefore waste material and increase costs.

SUMMARY OF THE INVENTION

The present invention provides a single-piece connector that uses less material, and is therefore more economical to produce, than connectors in the prior art. In particular the diagonally-slanted support leg, preferably reinforced with shallow walls on either side, eliminates the need for an additional member to support or reinforce the seat member.

The present invention provides a connector that can be used, and a connection that can be made, inside the walls of the structure, thereby eliminating the exposure of coil strap, as in the prior art, which must be attached to the outer faces of the wall studs.

The present invention provides a connector with obround openings that permit limited adjustability and ease installation in narrow wall cavities.

The present invention provides a connection that is easy to install because it uses standard all thread rod, which is easily procured and can be easily run through a hole or holes drilled in the sill plates of the floor structure between the connected wall studs.

DETAILED DESCRIPTION OF THE INVENTION

Figure 1:
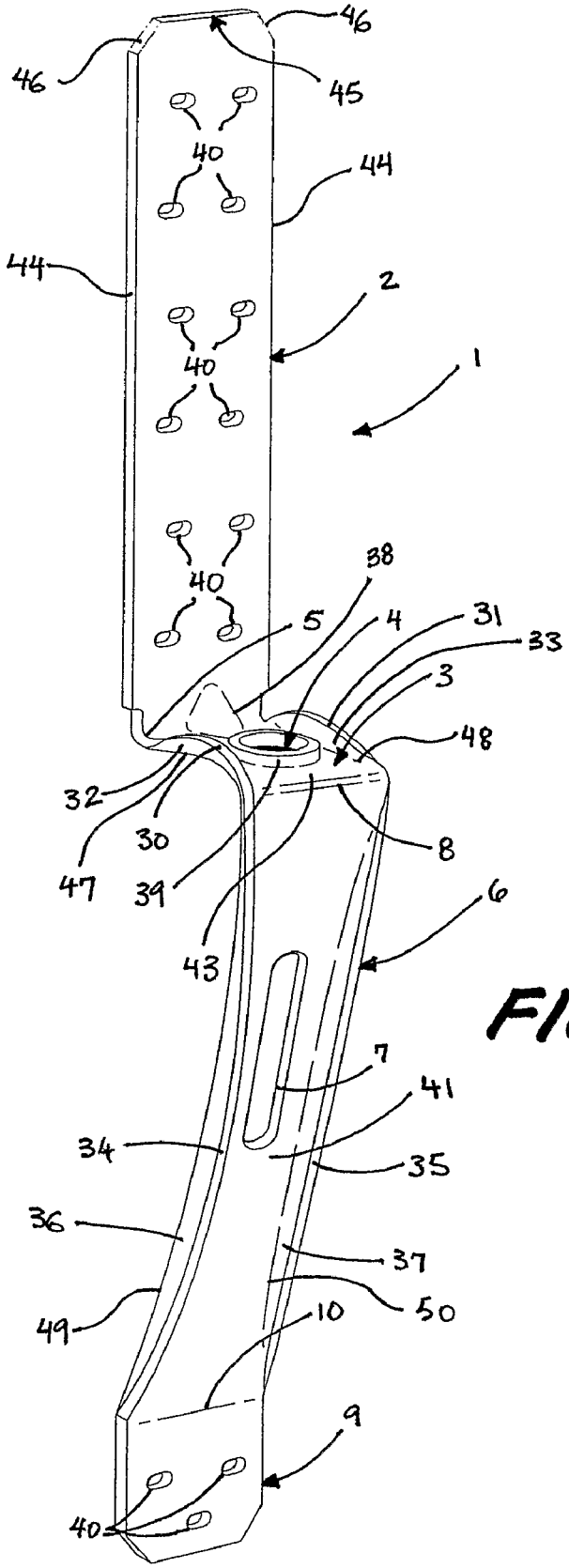
FIG. 1 is a perspective view of the connector of the present invention.
Figure 2:
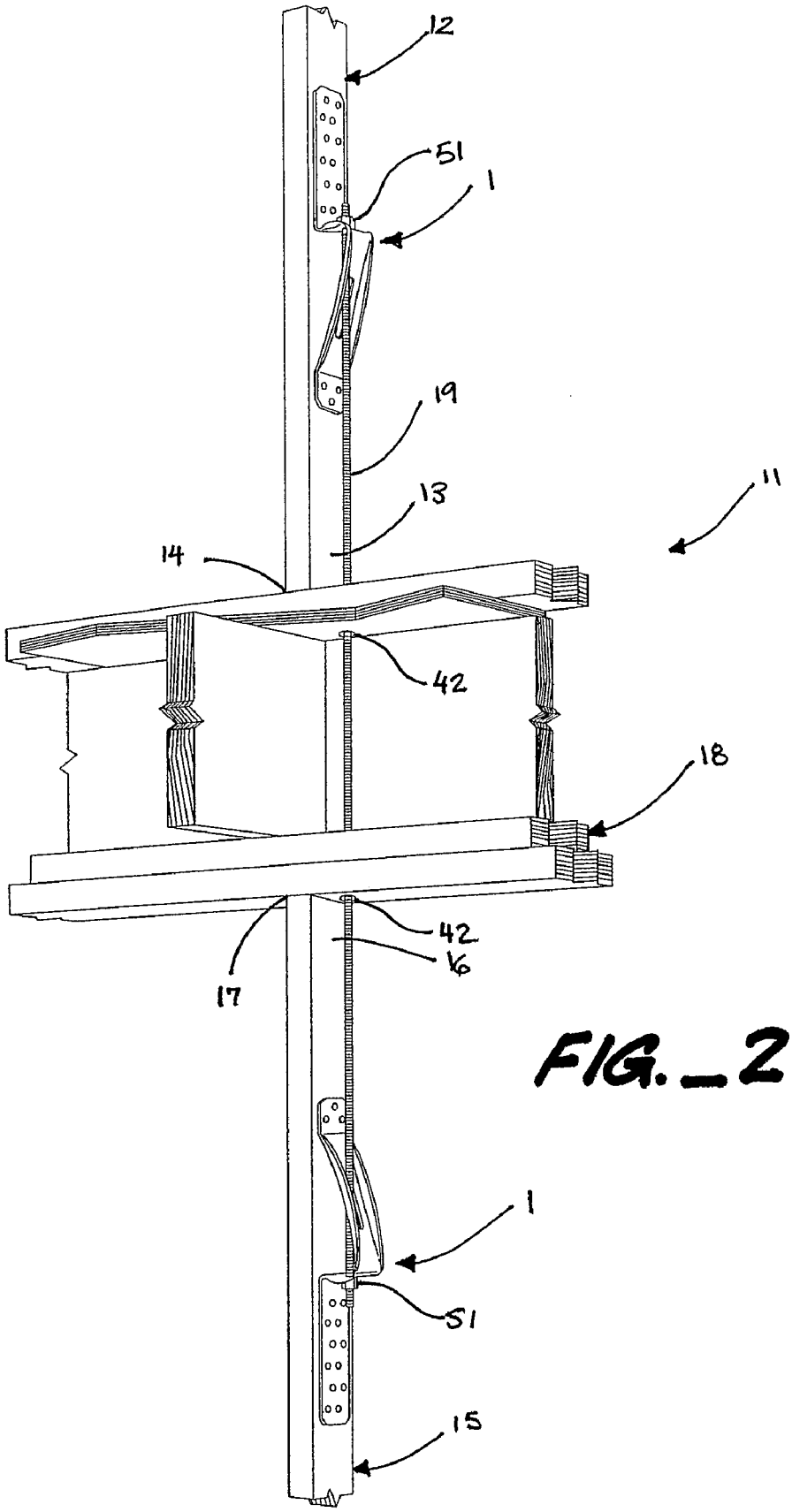
FIG. 2 is a perspective view of the connection of the present invention.
Figure 3:
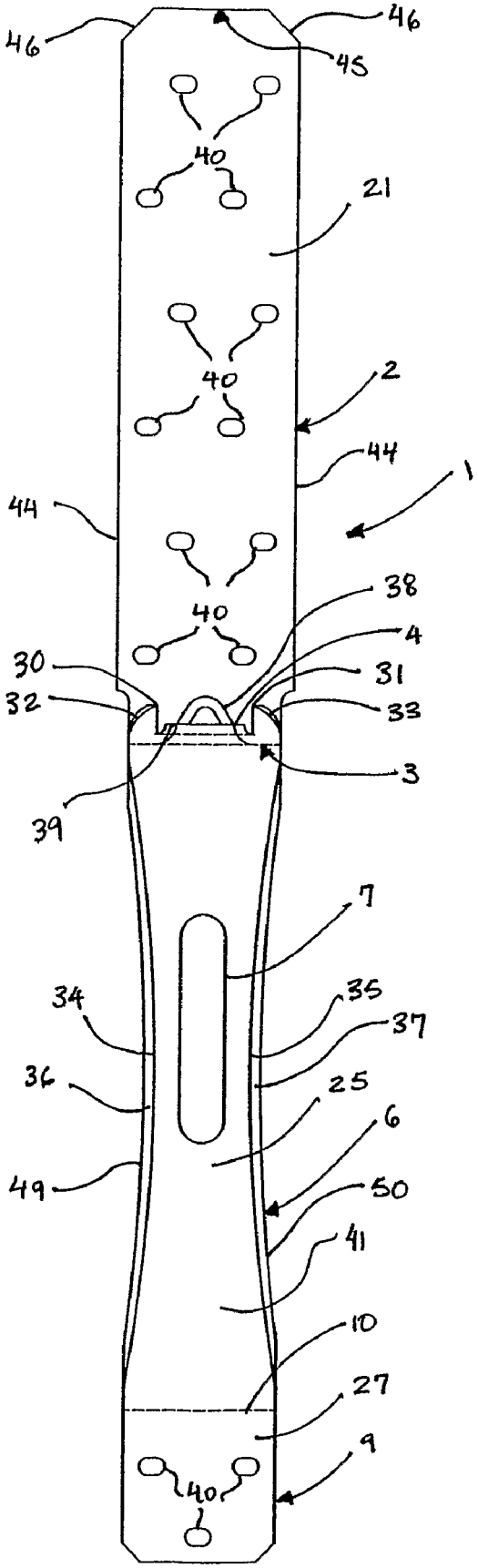
FIG. 3 is a front elevation view of the connector of the present invention.
Figure 4:
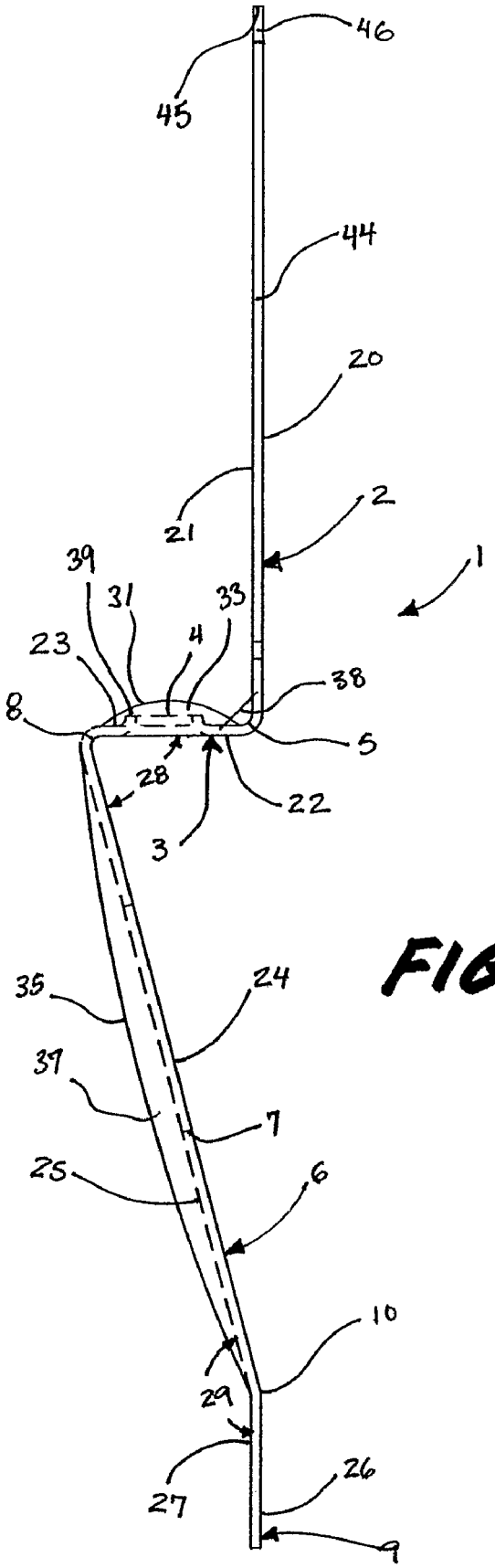
FIG. 4 is a side elevation view of the connector of the present invention.
Figure 5:
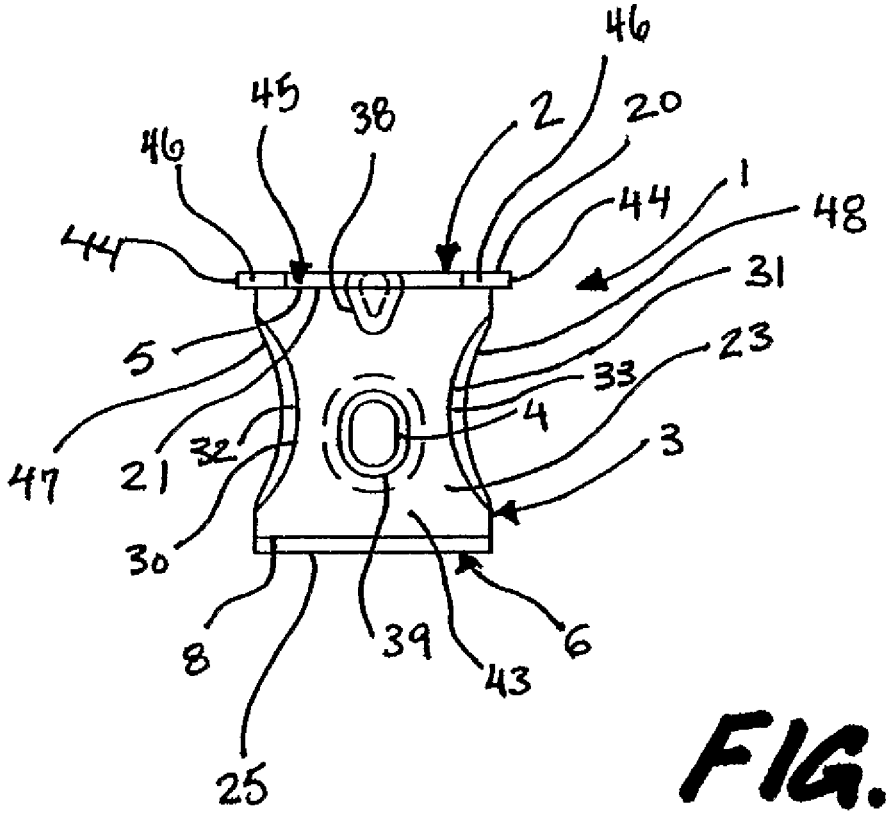
FIG. 5 is a top plan view of the connector of the present invention.

The connector 1 of the present invention is preferably formed out of galvanized sheet steel using automated machinery. The connector 1 is preferably formed by cutting, punching and bending the sheet steel. However, the connector 1 can be formed by any appropriate method and material, for instance by casting metals such as aluminum and molding plastics.

At its most basic, the connector 1 of the present invention comprises a first substantially planar attachment tab 2, a first substantially planar seat member 3, a first substantially planar support leg 6, and a second substantially planar attachment tab 9.

Preferably, the first attachment tab 2 has an attachment face 20 and an opposite outer face 21. Preferably, the first attachment tab 2 is elongated, with two relatively long and parallel side edges 44 and a relatively short end edge 45 that connects the two side edges 44. The end edge 45 preferably has two diagonal end portions 46 that cut off what would otherwise be sharp corners on the first attachment tab 2.

The first seat member 3 preferably has an inner face 22 and an opposite outer face 23. The first seat member 3 has a first tie member opening 4, which is preferably obround to allow a degree of adjustability. The first seat member is integrally connected to the first attachment tab 2 at a first bend line 5, which is preferably straight.

Preferably, the first support leg 6 has an inner face 24 and an opposite outer face 25. The first support leg 6 has a second tie member opening 7. The first support leg 6 is integrally attached to the first seat member 3 at a second bend line 8, which is preferably straight. The first bend line 5 and the second bend line 8 are substantially parallel to each other and are separated from each other by the first seat member 3.

The second substantially planar attachment tab 9 preferably has an attachment face 26 and an opposite outer face 27. The second attachment tab 9 is integrally attached to the first support leg 6 at a third bend line 10, which is preferably straight. The second bend line 8 and said third bend line 10 are substantially parallel to each other and separated from each other by said first support leg 6.

Preferably, the first attachment tab 2 and the first seat member 3 are substantially orthogonal. The inner face 22 of the first seat member 3 and said inner face 24 of the first support leg 6 preferably define a first angle 28 that is acute. Preferably, the outer face 25 of the first support leg 6 and the outer face 27 of said second attachment tab 9 define a second angle 29 that is obtuse.

The first seat member 3 preferably has a first edge 30 and a second edge 31. Preferably, the first edge 30 of the first seat member 3 is bent toward the outer face 23 of the first seat member 3 to form a first reinforcing side wall 32. The second edge 31 of the first seat member 3 is preferably bent toward the outer face 23 of the first seat member 3 to form a second reinforcing side wall 33.

Preferably, the first seat member 3 has a central portion 43 between the first reinforcing side wall 32 and the second reinforcing side wall 33 of the first seat member (3). The first reinforcing side wall 32 and the second reinforcing side wall 33 of the first seat member 3 preferably converge between the first bend line 5 and the second bend line 8 so that the central portion 43 of the first seat member 3 narrows between the first bend line 5 and the second bend line 8. Preferably, the first reinforcing side wall 32 is bent up along a first bend 47 and the second reinforcing side wall 33 is bent up along a second bend 48. The first bend 47 and the second bend 48 preferably form two shallow inward-facing arcs in the first seat member 3.

The first support leg 6 preferably has a first edge 34 and a second edge 35. Preferably, the first edge 34 of the first support leg 6 is bent toward the outer face 25 of said first support leg 6 to form a first reinforcing side wall 36. The second edge 35 of the first support leg 6 is preferably bent toward the outer face 25 of the first support leg 6 to form a second reinforcing side wall 37.

Preferably, the first support leg 6 has a central portion 41 between the first reinforcing side wall 36 and the second reinforcing side wall 37 of said first support leg 6. The first reinforcing side wall 36 and the second reinforcing side wall 37 of the first support leg 6 preferably converge between the second bend line 8 and the third bend line 10 so that the central portion 41 of the first support leg 6 narrows between the second bend line 8 and the third bend line 10. Preferably, the first reinforcing side wall 36 is bent up along a first bend 49 and the second reinforcing side wall 37 is bent up along a second bend 50. The first bend 49 and the second bend 50 preferably form two shallow inward-facing arcs in the first support leg 6.

Preferably, the first bend line 5 has a first reinforcing gusset 38 that bridges the first bend line 5 from the outer face 21 of the first attachment tab 2 to the outer face 23 of the first seat member 3.

The first tie member opening 4 preferably has a reinforcing rim 39 that is bent toward the outer face 23 of the first seat member 3. Preferably, the first tie member opening 4 is preferably obround to provide a degree of lateral adjustability.

The second tie member opening 7 is preferably obround. Because of the angle of the first support leg 6, the second tie member opening must be elongated.

Preferably, the first attachment tab 2 has a plurality of fastener openings 40, and the second attachment tab 9 also has a plurality of fastener openings 40. Most preferably, the first attachment tab 2 has twelve fastener openings and the second attachment tab 9 has three fastener openings 40. The fastener openings 40 in the first attachment tab 2 and said second attachment tab 9 preferably are obround, providing a degree of lateral adjustability.

The connector 1 of the present invention is preferably formed first by cutting the connector 1 from sheet metal, preferably 12 gauge galvanized sheet steel. Preferably, the first seat member 3 is bent up from the first attachment tab 2 at the first bend line 5. The first support leg 6 is preferably bent down from the first seat member 3 at the second bend line 8. Preferably, the second attachment tab 9 is bent up from the first support leg 6 at the third bend line 10.

At its most basic, the connection 11 of the present invention comprises a first structural member 12, a second structural member 15, a third structural member 18 between the first structural member 12 and the second structural member 15, a first connector 1 attached to the first structural member 12, a second connector 1 attached to the second structural member 15, and a first tie member 19 interconnecting the first connector 1 and the second connector 1.

Preferably, the first structural member 12 has a first side face 13 and a first end 14. The second structural member 15 preferably has a first side face 16 and a first end 17. Preferably, the third structural member 18 is sandwiched between the first end 14 of the first structural member 12 and the first end 17 of the second structural member 15.

The first connector 1 is preferably attached to the first side face 13 of the first structural member 12. Preferably, the second connector 1 is attached to the first side face 16 of the second structural member 15.

Preferably, the first tie member 19 is restrained against the first seat member 3 of the first connector 1 and restrained against the first seat member 3 of the second connector 1. Preferably, the first tie member 19 is all thread rod (ATR), preferably ⅜" (0.9525 centimeter) in diameter. The first tie member 19 is preferably 4 to 5 feet (1.2192 to 1.524 meters) long and grade A307 or better. Preferably, the first tie member 19 is restrained with matching nuts 51, preferably augmented with cut washers. The first tie member 19 preferably passes through the first tie member opening 4 and the second tie member opening 7 in the first connector (1), and the first tie member 19 passes through the first tie member opening 4 and the second tie member opening 7 in the second connector 1.

Preferably, the first structural member 12 and the second structural member 15 are vertically oriented, the third structural member 18 is horizontally oriented, and the first tie member 19 is vertically oriented. In the preferred embodiment, the connection 11 of the present invention is a vertical floor-to-floor connection 11. However, the connector 1 of the present invention could be used in a horizontal purlin-to-purlin connection 11 or the like. The connector 1 of the present invention could also be used singly, rather than paired, for example as a holdown.

The first structural member 12 is preferably an upper-storey wall stud 12. The second structural member 15 is preferably a lower-storey wall stud 15. The third structural member 18 is preferably an intervening floor 18.

Preferably, the floor 18 comprises a horizontal bottom plate 20, a floor diaphragm 21 and a floor beam 22. The bottom plate 20 supports the first structural member 12, the first end 14 of the first structural member 12 resting on the bottom plate 20. The floor diaphragm 21 supports the bottom plate 20. The floor beam 22 supports the floor diaphragm and preferably rests on a top plate 23. The top plate 23 rests on the first end 17 of said second structural member 15 and the top plate 23 is supported by the second structural member 15. In this embodiment, the first end 14 of the first structural member 12 is the lower end 14 of the first structural member 12 and the first end 17 of the second structural member 14 is the upper end 17 of the second structural member 14.

The top plate 23 is preferably a double top plate 23. Preferably, the first structural member 12, the second structural member 15, the bottom plate 20, and the top plate 23 are all formed from nominal 2×4" lumber. The connector 1 of the present invention is preferably used on at least a single 2× stud. The lumber is preferably Douglas Fir, Larch or Southern Pine. Alternatively, Spuce, Pine, Fir or Hem Fir may be used. The allowable tension load (the maximum load that the connection 11 is designed to provide) for the connection 11 of the present invention 1830 pounds (830.074 kilograms) with Douglas Fir, Larch or Southern Pine and 1570 pounds (712.140 kilograms) with Spuce, Pine, Fir or Hem Fir. Load values are based on a minimum lumber thickness of 1½" (3.81 centimeters).

Preferably, a first plurality of fasteners 24 attaches the first attachment tab 2 of the first connector 1 to the first side face 13 of the first structural member 12. A second plurality of fasteners 24 preferably attaches the second attachment tab 9 of the first connector 1 to the first side face 13 of the first structural member 12. Preferably, a third plurality of fasteners 24 attaches the first attachment tab 2 of the second connector 1 to the first side face 16 of the second structural member 15. A fourth plurality of fasteners 24 preferably attaches the second attachment tab 9 of the second connector 1 to the first side face 16 of the second structural member 15. Although separate mechanical fasteners 24 are preferred, integral mechanical fasteners 24 such as nail prongs could be employed, for instance if the connectors 1 were factory pre-installed on the structural members. Similarly, fasteners 24 could be eliminated if the connectors 1 were attached with a sufficiently strong adhesive or if they were welded or otherwise bonded to structural members made of materials other than wood, such as metals or plastics, particularly if the connectors 2 were likewise. Most preferably, the fasteners 24 are nails 24, specifically fifteen 10 d×1½" (0.148 inch [0.375 92 centimeter] diameter by 1.5 inches [3.81 centimeters] long) nails. Preferably, the nails 24 are driven straight into the first structural member 12 and the second structural member 15, but the connection 11 of the present invention preferably allows for the nails 24 to be driven in at up to a 30 degree angle with no reduction in load capacity.

The first connector 1 is preferably attached to the first side face 13 of the first structural member 12 proximate the first end 14 of the first structural member 12, preferably no more than 18" (45.72 centimeters) from the third structural member 18. Preferably, the second connector 1 is attached to the first side face 16 of the second structural member 15 proximate the first end 17 of the second structural member 15, preferably no more than 18" (45.72 centimeters) from the third structural member 18.

The preferred method of making the connection 11 of the present invention consists first of selecting the first structural member 12, the second structural member (15), and the third structural member (18). The preferred method then consists of placing the third structural member 18 between the first end 14 of the first structural member 12 and the first end 17 of the second structural member (15). As most preferably practiced, this is done as part of erecting a multistory structure, with a plurality of wall studs in each story wall and a floor between each pair of stories. The preferred method then consists of attaching the first connector 1 to the first side face 13 of the first structural member 12, and attaching the second connector 1 to the first side face 16 of the second structural member 15.

Then a hole 42 is preferably drilled in, and though, the third structural member 18. Preferably, the hole 42 is ½" to ¾" (1.27 to 1.905 centimeters) in diameter and approximately 1½" (3.81 centimeters) away from the first side face 13 of the first structural member 12 and the first side face 16 of the second structural member 15. The preferred method then consists of passing the first tie member 19 through the hole 42 in the third structural member 18, passing the first tie member 19 through the first tie member opening 4) and the second tie member opening 7 in the first connector 1, and passing the first tie member 19 through the first tie member opening 4 and the second tie member opening 7 in the second connector 1.

Finally, the method of making the connection 11 of the present invention consists of restraining the first tie member 19 against the first seat member 3 of the first connector 1 and against the first seat member 3 of the second connector 1. The first tie member 19, which is preferably ⅜" (0.9525 centimeter) all thread rod (ATR), is preferably restrained with matching nuts 51 and standard cut washers. Preferably, the connectors 1 are offset no more than 3" (7.62 centimeters) from each other.

I claim:

1. A connector (1) comprising:

a. a first substantially planar attachment tab (2) having an attachment face (20) and an opposite outer face (21);

b. a first substantially planar seat member (3) having an inner face (22), an opposite outer face (23), and a first tie member opening (4), said first seat member (3) being integrally connected to said first attachment tab (2) at a first bend line (5);

c. a first substantially planar support leg (6) having an inner face (24), an opposite outer face (25), and a second tie member opening (7), said first support leg (6) being integrally attached to said first seat member (3) at a second bend line (8), said first bend line (5) and said second bend line (8) being substantially parallel to each other and separated from each other by said first seat member (3); and d. a second substantially planar attachment tab (9) having an attachment face (26) and an opposite outer face (27), said second attachment tab (9) being integrally attached to said first support leg (6) at a third bend line (10), said second bend line (8) and said third bend line (10) being substantially parallel to each other and separated from each other by said first support leg (6); wherein:

i. said first attachment tab (2) and said first seat member (3) are substantially orthogonal;

ii. said inner face (22) of said first seat member (3) and said inner face (24) of said first support leg (6) define a first angle (28) that is acute;

iii. said outer face (25) of said first support leg (6) and said outer face (27) of said second attachment tab (9) define a second angle (29) that is obtuse;

iv. said first substantially planar attachment tab (2) and said second substantially planar attachment tab (9) are aligned in a single plane and are separated by said first substantially planar seat member (3) and said first substantially planar support leg (6) and are connected only through said first substantially planar seat member (3) and said first substantially planar support leg (6);

v. said first substantially planar seat member (3) is orthogonal to said second substantially planar attachment tab (9); and vi. said first tie member opening (4) and said second tie member opening (7) are substantially aligned such that a substantially straight elongated first tie member (19) may pass through said first tie member opening (4) and said second tie member opening (7).

2. The connector (1) of claim 1 wherein:

a. said first seat member (3) has a first edge (30) and a second edge (31);

b. said first edge (30) of said first seat member (3) is bent toward said outer face (23) of said first seat member (3) to form a first reinforcing side wall (32); and c. said second edge (31) of said first seat member (3) is bent toward said outer face (23) of said first seat member (3) to form a second reinforcing side wall (33).

3. The connector (1) of claim 2 wherein:

a. said first seat member (3) has a central portion (43) between said first reinforcing side wall (32) and said second reinforcing side wall (33) of said first seat member (3); and b. said first reinforcing side wall (32) and said second reinforcing side wall (33) of said first seat member (3) converge between said first bend line (5) and said second bend line (8) so that said central portion (43) of said first seat member (3) narrows between said first bend line (5) and said second bend line (8).

4. The connector (1) of claim 1 wherein:

a. said first support leg (6) has a first edge (34) and a second edge (35);

b. said first edge (34) of said first support leg (6) is bent toward said outer face (25) of said first support leg (6) to form a first reinforcing side wall (36); and c. said second edge (35) of said first support leg (6) is bent toward said outer face (25) of said first support leg (6) to form a second reinforcing side wall (37).

5. The connector (1) of claim 4 wherein:

a. said first support leg (6) has a central portion (41) between said first reinforcing side wall (36) and said second reinforcing side wall (37) of said first support leg (6); and b. said first reinforcing side wall (36) and said second reinforcing side wall (37) of said first support leg (6) converge between said second bend line (8) and said third bend line (10) so that said central portion (41) of said first support leg (6) narrows between said second bend line (8) and said third bend line (10).

6. The connector (1) of claim 1 wherein:

a. said first bend line (5) has a first reinforcing gusset (38) that bridges said first bend line (5) from said outer face (21) of said first attachment tab (2) to said outer face (23) of said first seat member (3).

7. The connector (1) of claim 1 wherein:

a. said first tie member opening (4) has a reinforcing rim (39) that is bent toward said outer face (23) of said first seat member (3).

8. The connector (1) of claim 1 wherein:

a. said second tie member opening (7) is obround.

9. The connector (1) of claim 1 wherein:

a. said first attachment tab (2) has a plurality of fastener openings (40); and b. said second attachment tab (9) has a plurality of fastener openings (40).

10. The connector (1) of claim 8 wherein:

a. said fastener openings (40) in said first attachment tab (2) and said second attachment tab (9) are obround.

11. A method of forming the connector (1) of claim 1, comprising:

a. cutting said connector (1) from sheet metal;

b. bending said first seat member (3) up from said first attachment tab (2) at said first bend line (5);

c. bending said first support leg (6) down from said first seat member (3) at said second bend line (8); and d. bending said second attachment tab (9) up from said first support leg (6) at said third bend line (10).

12. A connection (11) comprising:

a. a first structural member (12) having a first side face (13) and a first end (14);

b. a second structural member (15) having first side face (16) a first end (17);

c. a third structural member (18) between said first end (13) of said first structural member (12) and said first end (17) of said second structural member (15);

d. a first connector (1) attached to said first side face (13) of said first structural member (12), said first connector (1) comprising:

i. a first substantially planar attachment tab (2) having an attachment face (20) and an opposite outer face (21);

ii. a first substantially planar seat member (3) having an inner face (22), an opposite outer face (23), and a first tie member opening (4), said first seat member (3) being integrally connected to said first attachment tab (2) at a first bend line (5);

iii. a first substantially planar support leg (6) having an inner face (24), an opposite outer face (25), and a second tie member opening (7), said first support leg (6) being integrally attached to said first seat member (3) at a second bend line (8), said first bend line (5) and said second bend line (8) being substantially parallel to each other and separated from each other by said first seat member (3); and iv. a second substantially planar attachment tab (9) having an attachment face (26) and an opposite outer face (27), said second attachment tab (9) being integrally attached to said first support leg (6) at a third bend line (10), said second bend line (8) and said third bend line (10) being substantially parallel to each other and separated from each other by said first support leg (6); wherein:

1. said first attachment tab (2) and said first seat member (3) are substantially orthogonal;

2. said inner face (22) of said first seat member (3) and said inner face (24) of said first support leg (6) define a first angle (28) that is acute;

3. said outer face (25) of said first support leg (6) and said outer face (27) of said second attachment tab (9) define a second angle (29) that is obtuse;

e. a second connector (1) attached to said first side face (16) of said second structural member (15), said second connector (1) comprising:

i. a first substantially planar attachment tab (2) having an attachment face (20) and an opposite outer face (21);

ii. a first substantially planar seat member (3) having an inner face (22), an opposite outer face (23), and a first tie member opening (4), said first seat member (3) being integrally connected to said first attachment tab (2) at a first bend line (5);

iii. a first substantially planar support leg (6) having an inner face (24), an opposite outer face (25), and a second tie member opening (7), said first support leg (6) being integrally attached to said first seat member (3) at a second bend line (8), said first bend line (5) and said second bend line (8) being substantially parallel to each other and separated from each other by said first seat member (3); and iv. a second substantially planar attachment tab (9) having an attachment face (26) and an opposite outer face (27), said second attachment tab (9) being integrally attached to said first support leg (6) at a third bend line (10), said second bend line (8) and said third bend line (10) being substantially parallel to each other and separated from each other by said first support leg (6); wherein:

1. said first attachment tab (2) and said first seat member (3) are substantially orthogonal;

2. said inner face (22) of said first seat member (3) and said inner face (24) of said first support leg (6) define a first angle (28) that is acute;

3. said outer face (25) of said first support leg (6) and said outer face (27) of said second attachment tab (9) define a second angle (29) that is obtuse;

f. a first tie member (19) restrained against said first seat member (3) of said first connector (1) and restrained against said first seat member (3) of said second connector (1), said first tie member (19) passing through said first tie member opening (4) and said second tie member opening (7) in said first connector (1), and said first tie member (19) passing through said first tie member opening (4) and said second tie member opening (7) in said second connector (1).

13. The connection (11) of claim 12 wherein:

a. said first structural member (12) is vertically oriented;

b. said second structural member (15) is vertically oriented;

c. said third structural member (18) is horizontally oriented; and d. said first tie member (19) is vertically oriented.

14. The connection (11) of claim 13 wherein:

a. said first structural member (12) is an upper-storey wall stud (12);

b. said second structural member (15) is a lower-storey wall stud (15);

c. said third structural member (18) is an intervening floor (18).

15. The connection (11) of claim 14 wherein:

a. said first tie member (19) is all thread rod (19).

16. The connection (11) of claim 15 wherein:

a. said floor (18) comprises:

i. a horizontal bottom plate (20) that supports said first structural member (12), said first end (14) of said first structural member (12) resting on said bottom plate (20);

ii. a floor diaphragm (21) that supports said bottom plate (20); and iii. a floor beam (22) that supports said floor diaphragm and rests on a top plate (23); wherein:

1. said top plate (23) rests on said first end (17) of said second structural member (15) and said top plate (23) is supported by said second structural member (15).

17. The connection of claim 16 wherein:

a. said top plate (23) is a double top plate (23).

18. The connection of claim 16 wherein:

a. said first structural member (12), said second structural member (15), said bottom plate (20), and said top plate (23) are all formed from nominal 2×4" lumber.

19. The connection (11) of claim 16 wherein:

a. a first plurality of fasteners (24) attaches said first attachment tab (2) of said first connector (1) to said first side face (13) of said first structural member (12);

b. a second plurality of fasteners (24) attaches said second attachment tab (9) of said first connector (1) to said first side face (13) of said first structural member (12);

c. a third plurality of fasteners (24) attaches said first attachment tab (2) of said second connector (1) to said first side face (16) of said second structural member (15); and d. a fourth plurality of fasteners (24) attaches said second attachment tab (9) of said second connector (1) to said first side face (16) of said second structural member (15).

20. The connection (11) of claim 9 wherein:

a. said fasteners (24) are nails (24).

21. The connection (11) of claim 16 wherein:

a. said first connector (1) is attached to said first side face (13) of said first structural member (12) proximate said first end (14) of said first structural member (12).

22. The connection (11) of claim 19 wherein:

a. said second connector (1) is attached to said first side face (16) of said second structural member (15) proximate said first end (17) of said second structural member (15).

23. A method of making the connection (11) of claim 12 comprising:

a. selecting said first structural member (12);

b. selecting said second structural member (15);

c. selecting said third structural member (18);

d. placing said third structural member (18) between said first end (14) of said first structural member (12) and said first end (17) of said second structural member (15);

e. attaching said first connector (1) to said first side face (13) of said first structural member (12);

f. attaching said second connector (1) to said first side face (16) of said second structural member (15);

g. drilling a hole (42) in said third structural member (18);

h. passing said first tie member (19) through said hole (42) in said third structural member (18);

i. passing said first tie member (19) through said first tie member opening (4) and said second tie member opening (7) in said first connector (1), and passing said first tie member (19) through said first tie member opening (4) and said second tie member opening (7) in said second connector (1); and j. restraining said first tie member (19) against said first seat member (3) of said first connector (1) and against said first seat member (3) of said second connector (1).

24. A connection (11) comprising:

a. a first structural member (12) having a first side face (13) and a first end (14);

b. a second structural member (15) having first side face (16) and a first end (17);

c. a third structural member (18) between said first end (13) of said first structural member (12) and said first end (17) of said second structural member (15);

d. a first connector (1) attached to said first side face (13) of said first structural member (12), said first connector (1) comprising:

i. a first substantially planar attachment tab (2) having an attachment face (20) and an opposite outer face (21) said attachment face (20) interfacing with said first side face (13) of said first structural member (12);

ii. a first substantially planar seat member (3) having an inner face (22), an opposite outer face (23), and a first tie member opening (4), said first seat member (3) being integrally connected to said first attachment tab (2) at a first bend line (5);

iii. a first substantially planar support leg (6) having an inner face (24), an opposite outer face (25), and a second tie member opening (7), said first support leg (6) being integrally attached to said first seat member (3) at a second bend line (8), said first bend line (5) and said second bend line (8) being substantially parallel to each other and separated from each other by said first seat member (3); and iv. a second substantially planar attachment tab (9) having an attachment face (26) and an opposite outer face (27) said attachment face (26) interfacing with said first side face (13) of said first structural member (12), said second attachment tab (9) being integrally attached to said first support leg (6) at a third bend line (10), said second bend line (8) and said third bend line (10) being substantially parallel to each other and separated from each other by said first support leg (6); wherein:

1. said first attachment tab (2) and said first seat member (3) are substantially orthogonal;

2. said inner face (22) of said first seat member (3) and said inner face (24) of said first support leg (6) define a first angle (28) that is acute;

3. said outer face (25) of said first support leg (6) and said outer face (27) of said second attachment tab (9) define a second angle (29) that is obtuse;

e. a first tie member (19) restrained against said first seat member (3) of said first connector (1) and attached to said third structural member (18), said first tie member (19) passing through said first tie member opening (4) and said second tie member opening (7) in said first connector (1).

25. The connection (11) of claim 24, wherein:

a. said first substantially planar attachment tab (2) and said second substantially planar attachment tab (9) are aligned in a single plane and are separated by said first substantially planar seat member (3) and said first substantially planar support leg (6) and said first substantially planar seat member (3) is orthogonal to said second substantially planar attachment tab (9).

26. The connection (11) of claim 25 wherein:

a. said first seat member (3) has a first edge (30) and a second edge (31);

b. said first edge (30) of said first seat member (3) is bent toward said outer face (23) of said first seat member (3) to form a first reinforcing side wall (32); and c. said second edge (31) of said first seat member (3) is bent toward said outer face (23) of said first seat member (3) to form a second reinforcing side wall (33).

27. The connection (11) of claim 26 wherein:

a. said first seat member (3) has a central portion (43) between said first reinforcing side wall (32) and said second reinforcing side wall (33) of said first seat member (3); and b. said first reinforcing side wall (32) and said second reinforcing side wall (33) of said first seat member (3) converge between said first bend line (5) and said second bend line (8) so that said central portion (43) of said first seat member (3) narrows between said first bend line (5) and said second bend line (8).

28. The connection (11) of claim 27 wherein:

a. said first support leg (6) has a first edge (34) and a second edge (35);

b. said first edge (34) of said first support leg (6) is bent toward said outer face (25) of said first support leg (6) to form a first reinforcing side wall (36); and c. said second edge (35) of said first support leg (6) is bent toward said outer face (25) of said first support leg (6) to form a second reinforcing side wall (37).

29. The connection (11) of claim 28 wherein:

a. said first support leg (6) has a central portion (41) between said first reinforcing side wall (36) and said second reinforcing side wall (37) of said first support leg (6); and b. said first reinforcing side wall (36) and said second reinforcing side wall (37) of said first support leg (6) converge between said second bend line (8) and said third bend line (10) so that said central portion (41) of said first support leg (6) narrows between said second bend line (8) and said third bend line (10).

30. The connection (11) of claim 29 wherein:

a. said first bend line (5) has a first reinforcing gusset (38) that bridges said first bend line (5) from said outer face (21) of said first attachment tab (2) to said outer face (23) of said first seat member (3).

31. The connection (11) of claim 24 wherein:

a. said first tie member opening (4) has a reinforcing rim (39) that is bent toward said outer face (23) of said first seat member (3).

32. The connection (11) of claim 25 wherein:

a. a first plurality of fasteners (24) attaches said first attachment tab (2) of said first connector (1) to said first side face (13) of said first structural member (12);

b. a second plurality of fasteners (24) attaches said second attachment tab (9) of said first connector (1) to said first side face (13) of said first structural member (12).

* * * * *